US007950790B2

(12) United States Patent
Kubo et al.

(10) Patent No.: US 7,950,790 B2
(45) Date of Patent: May 31, 2011

(54) INK CONTAINER AND INK JET RECORDING APPARATUS

(75) Inventors: Koichi Kubo, Yokohama (JP); Yasuo Kotaki, Yokohama (JP); Tetsuya Ohashi, Matsudo (JP); Hitoshi Takada, Yokohama (JP); Ryoji Inoue, Kawasaki (JP); Hideki Ogura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 771 days.

(21) Appl. No.: 11/850,279

(22) Filed: Sep. 5, 2007

(65) Prior Publication Data

US 2008/0062231 A1 Mar. 13, 2008

(30) Foreign Application Priority Data

Sep. 11, 2006 (JP) ..... 2006-246045

(51) Int. Cl.
*B41J 2/175* (2006.01)

(52) U.S. Cl. ..... 347/86; 347/84; 347/85

(58) Field of Classification Search ..... 347/6, 7, 347/84–86

See application file for complete search history.

(56) References Cited

U.S. PATENT DOCUMENTS

| | | | | |
|---|---|---|---|---|
| 5,567,373 | A | 10/1996 | Sato et al. | 264/112 |
| 5,657,058 | A * | 8/1997 | Mochizuki et al. | 347/7 |
| 5,815,184 | A | 9/1998 | Ujita et al. | 347/89 |
| 6,390,612 | B1 | 5/2002 | Kotaki et al. | 347/85 |
| 6,419,350 | B1 | 7/2002 | Abe et al. | 347/86 |
| 6,460,984 | B1 * | 10/2002 | Matsumoto et al. | 347/86 |
| 6,554,412 | B1 * | 4/2003 | Seino et al. | 347/86 |
| 6,623,104 | B1 | 9/2003 | Kotaki et al. | 347/49 |
| 6,719,416 | B2 | 4/2004 | Anma et al. | 347/86 |
| 6,742,881 | B2 | 6/2004 | Kotaki et al. | 347/86 |
| 6,877,847 | B2 | 4/2005 | Hayashi et al. | 347/86 |
| 6,916,085 | B2 | 7/2005 | Kotaki et al. | 347/49 |
| 6,942,326 | B2 | 9/2005 | Hayashi et al. | 347/86 |
| 7,134,747 | B2 | 11/2006 | Hayashi et al. | 347/86 |
| 2002/0051044 | A1 * | 5/2002 | Sasaki et al. | 347/86 |
| 2003/0214557 | A1 * | 11/2003 | Nakamura et al. | 347/49 |
| 2005/0200670 | A1 * | 9/2005 | Hashii et al. | 347/86 |
| 2006/0082624 | A1 | 4/2006 | Lee | 347/86 |
| 2007/0103515 | A1 * | 5/2007 | Hashii et al. | 347/58 |
| 2007/0229632 | A1 | 10/2007 | Hatasa et al. | 347/92 |
| 2007/0263052 | A1 | 11/2007 | Iijima et al. | 347/92 |

(Continued)

FOREIGN PATENT DOCUMENTS

JP 9-300646 11/1997

(Continued)

OTHER PUBLICATIONS

Korean Notice of Allowance dated May 31, 2010, from corresponding Korean Application No. 10-2007-0091556.

(Continued)

*Primary Examiner* — Ellen Kim

(74) *Attorney, Agent, or Firm* — Fitzpatrick, Cella, Harper & Scinto

(57) ABSTRACT

An ink container usable for recording heads different in flow rate without being affected by a pigment particle concentration of ink held in an ink supply portion is provided. In correspondence with a size of a filter of a recording head used, ink non-conducting areas are provided to a press-contact member, whereby movement of settled ink remaining in the press-contact member is blocked. As a result, common use of the ink container with respect to the recording heads different in flow rate is realized.

10 Claims, 10 Drawing Sheets

U.S. PATENT DOCUMENTS

2008/0088652 A1* 4/2008 Miyajima et al. ..... 347/6

FOREIGN PATENT DOCUMENTS

| | | |
|---|---|---|
| JP | 2004-216761 | 8/2004 |
| KR | 20060020052 | 3/2006 |
| KR | 20060033325 | 4/2006 |
| KR | 10-0612450 | 8/2006 |

OTHER PUBLICATIONS

Korean Office Action dated Jun. 30, 2009 from corresponding Korean Application No. 10-2007-0091556.

* cited by examiner

INK CONTAINER AND INK JET RECORDING APPARATUS

FIELD OF THE INVENTION AND RELATED ART

The present invention relates to an ink container and an ink jet recording apparatus. More specifically, the present invention relates to a constitution with respect to a connection between an ink suction operation of the ink container and an ink introducing portion of a recording head.

In recent years, an ink jet recording apparatus such as an ink jet printer having advantages of providing a high-quality recording image and less noise has been widely used. Particularly, the ink jet recording apparatus can be produced as a relatively small-size printer, so that a personal printer has been developed in many cases. In such a personal printer, a user replaces an ink jet cartridge integrally constituted by an ink container and a recording head to supply ink. Particularly, a constitution in which only the ink container is replaced can cut running costs when compared with a constitution in which the ink container is replaced together with the recording head.

With respect to such a replaceable ink container, Japanese Laid-Open Patent Application (JP-A) Hei 09-300646 has proposed a constitution for ensuring safety of user and inclusion of air during mounting and demounting of the ink container. Particularly, in FIGS. 5 to 7 of JP-A Hei 09-300646, a constitution in which a press-contact member (capillary member) is provided to an ink supply portion of the ink container has been disclosed. The press-contact member is constituted by an absorbing member, so that the press-contact member holds ink led from the inside of the ink container and discharges the ink, held depending on a change in negative pressure by ejection of the ink from a recording head, into a supply passage.

As the ink contained or accommodated in the ink container, dye ink using a dye as a colorant has been principally used. On the other hand, pigment ink using a pigment as the colorant has been put into practical use as ink which is improved in light and weather resistances of print to satisfy a performance required for the uses such as print for outdoor notice.

However, the pigment is dispersion-type coloring material, so that the pigment ink causes settling of pigment particles in the ink container. For example, in the case where the ink container is left standing for a long time while being mounted to the ink jet printer, the pigment particles are gradually settled in the ink container. For this reason, in the ink container, concentration gradient of the pigment particles occurs from a bottom toward an upper portion of the ink container. As a result, the ink located at the bottom of the ink container is increased in pigment particle concentration to form an excessively highly colored layer. On the other hand, the ink located at the upper portion of the ink container is decreased in pigment particle concentration to form an excessively lightly colored layer.

In the case where the ink in the ink container is led and supplied from the bottom of the ink container, first, ink having a high pigment particle concentration is supplied, so that an excessively highly colored image is recorded. That is, there is a possibility of an occurrence of a difference in recording (image) density between a recording image at an initial stage of the use of the ink container and a recording image at a late stage of the use of the ink container. Such a phenomenon is particularly noticeable in color recording for recording a color image on the basis of darkness of color.

In order to solve the problem, JP-A 2004-216761 has disclosed a constitution in which a stirring member movable by an inertial force generated by reciprocating motion of a carriage is disposed inside an ink container. By the reciprocating motion of the carriage, the stirring member is operated to stir the ink in the ink container. As a result, pigment particles in the ink can be prevented from causing concentration gradient thereof.

However, the stirring constitution described in JP-A 2004-216761 is effective only in suppressing settling of ink at a portion in which the ink is contained. In the case of the ink container provided with the press-contact member as described in JP-A Hei 09-300646, for example, a problem of the high pigment particle concentration of the ink which has already been present in the press-contact member cannot be solved.

In the case of using the press-contact member, uniformization of concentration of ink in the press-contact member is generally realized by employing a method in which high concentration ink in the press-contact member is removed by a suction operation from a main assembly of a recording apparatus.

Incidentally, the ink container is designed so that ink can be supplied in an amount corresponding to a recording speed of a recording head to be mounted. In this case, e.g., a size of a supply port of the ink container corresponds to the above described ink supply amount or an ink flow rate. Thus, in the case where a recording head providing a high ink flow rate is newly developed, it is necessary to develop a new ink container having a supply port capable of supplying ink at a flow rate corresponding to the ink flow rate of the recording head. As a result, with remarkable evolution of ink and a recording speed in recent years, types of ink containers are increased year by year to require considerable expenses for developing the new ink container and investment in plant and equipment for producing various models of printers.

Accordingly, in order to efficiently reduce production cost to provide an inexpensive product, it is desirable that an ink container meeting a recording speed of the future is developed to prevent an increase in the number of models of the product and reduce the cost of developing the new ink container. As one means for that purpose, a large opening (planar) area of an ink supply port of the ink container is designed in advance so that it is possible to realize a common ink container capable of meeting the increase in flow rate.

However, in the ink container including the press-contact member provided at the ink supply port as disclosed in JP-A Hei 09-300646, the press-contact member is used in common for realizing commonality of the opening area of the supply port. Accordingly, a size of the press-contact member is increased in correspondence with the opening area of the supply port. In the case of mounting the ink container to a recording head providing a relatively small flow rate, all of the ink held by the press-contact member cannot be removed by a suction operation in some cases. More specifically, a planar area of the opening of the supply port of the recording head contacting the press-contact member is smaller than a planar area of the press-contact member, so that the ink cannot be sucked from the press-contact member at portions located outside the supply port opening by the suction operation in some cases. Accordingly, the high concentration ink which cannot be removed by the suction operation and remains in the press-contact member gradually diffuses in the press-contact member after the suction operation, so that the high concentration ink can be finally discharged to the recording head. As a result, the recording head discharges the high concentration ink to cause image density non-uniformity of print in some cases.

SUMMARY OF THE INVENTION

A principal object of the present invention is to provide an ink container capable of being used in recording heads different in ink flow rate without being adversely affected by a pigment particle concentration or the like of ink held in a press-contact member.

Another object of the present invention is to provide an ink jet recording apparatus using the ink container.

According to an aspect of the present invention, there is provided an ink container, for containing ink, including a supply port for supplying the ink to a recording head, the ink container comprising:

a press-contact member connectable to an ink introducing portion of the recording head at the supply port, wherein the press-contact member has a plurality of conducting areas in which the ink is movable and an area which defines a boundary between the conducting areas and substantially isolates the conducting areas from each other.

According to another aspect of the present invention, there is provided an ink jet recording apparatus for effecting recording by using a recording head for ejecting ink, comprising:

mounting means to which the ink container, for containing the ink, including a supply port for supplying the ink to the recording head is detachably mountable; and suction means for sucking the ink through the recording head in a state in which the supply port of the ink container and an ink introducing portion are connected to each other, wherein the ink container includes a press-contact member which is connectable to the ink introducing portion of the recording head at the supply port and has a plurality of conducting areas in which the ink is movable and an area, defining a boundary between a plurality of conducting areas and substantially isolating the conducting areas from each other, in which the ink is non-conductible, and wherein the suction means is capable of sucking all of ink contained in a conducting area in contact with the ink introducing portion.

According to the above-described constitutions, movement of ink between the conducting areas is prevented by the non-conducting area of the press-contact member. Therefore, ink which does not contact the ink introducing portion of the recording head and remains in the press-contact member is not moved to other conducting areas. As a result, it is possible to prevent the high concentration ink from being discharged into the recording head and thus from adversely affecting a recording image.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 5A to 5C are sectional views for illustrating pigment settling at an inner portion of the press-contact member provided to the ink container shown in FIG. 4, wherein FIG. 5A shows a state after a stirring operation, FIG. 5B shows a state after a suction refreshing operation, and FIG. 5C shows a state after the ink container is subjected to the suction refreshing operation and then is left standing.

DETAILED DESCRIPTION OF THE PREFERRED EMBODIMENTS

Hereinbelow, embodiments of the present invention will be described in detail with reference to the drawings.

First Embodiment

Figure 1:
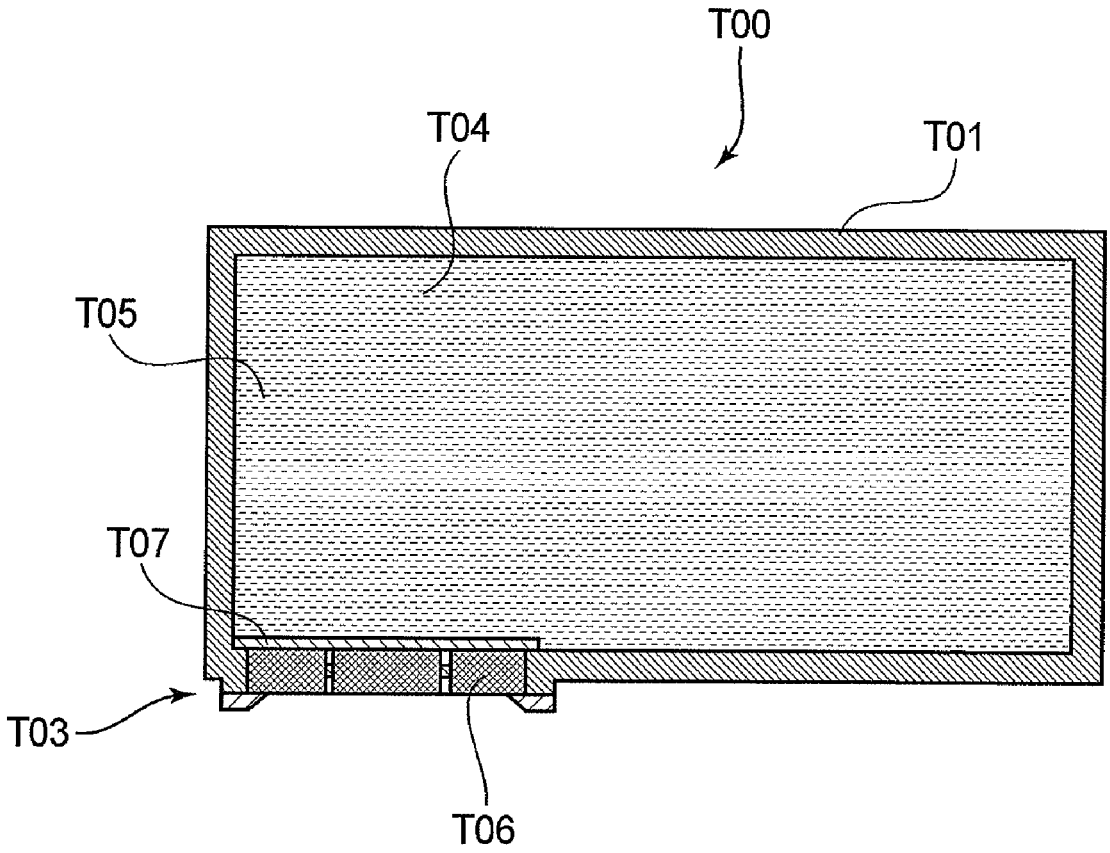
FIG. 1 is a sectional view of an ink container in First Embodiment of the present invention.
Figure 2A:
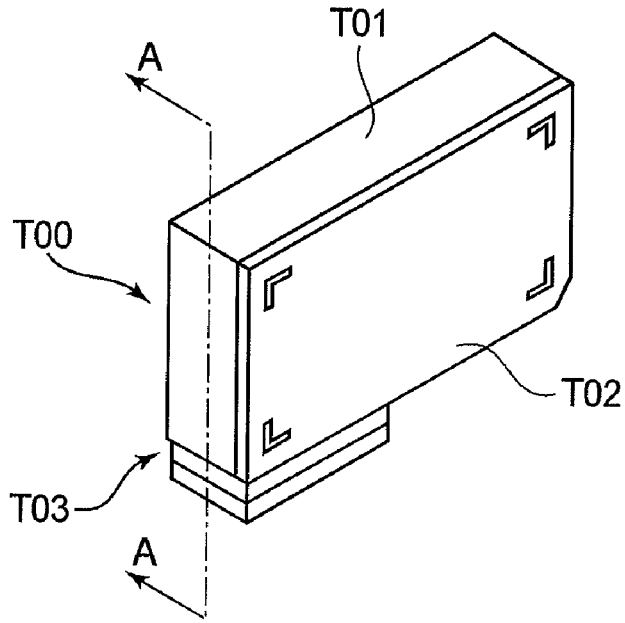
FIG. 2A is a perspective view of an outer appearance of the ink container in First Embodiment of the present invention.
Figure 2B:
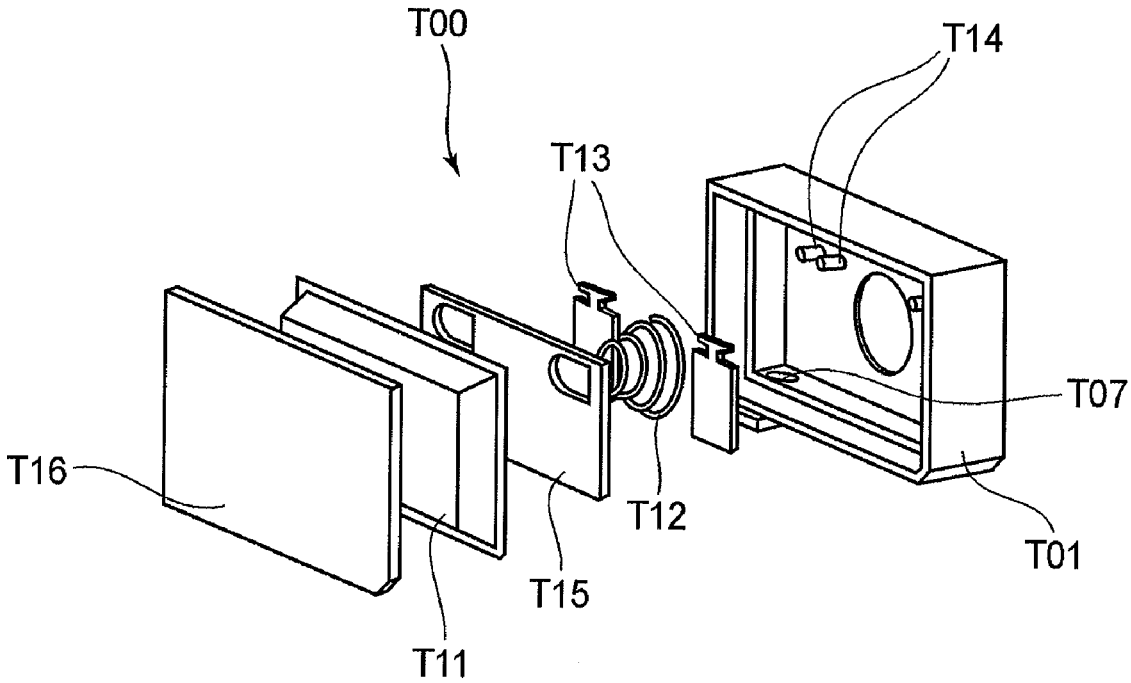
FIG. 2B is an exploded view of the ink container in First Embodiment of the present invention.

FIG. 1 is a sectional view of an ink container according to this embodiment of the present invention, and FIGS. 2A and 2B are perspective views of the ink container of this embodiment. FIG. 1 shows a sectional view taken along A-A line shown in FIG. 2A.

An ink container T00 is a container for containing or accommodating ink T05 and has a casing thereof constituted by a container body T01 and a cap member T02 as shown in FIG. 2A. At a bottom surface of the ink container T00 with respect to a gravitational direction, an ink supply portion T03 for supplying the ink T05 to a recording head is provided.

Inside the ink container T00, as shown in FIG. 1, an ink reservoir chamber T04 for containing the ink T05 is provided. The ink reservoir chamber T04 has an inner constitution as shown in FIG. 2B. Referring to FIG. 2B, the ink container T00 is constituted by the container body T01 and a cap member T16. At an inner wall surface of the container, a coil spring T12 is provided and presses a flexible sheet member T11 to expand the ink reservoir chamber T04, thus generating negative pressure for holding the ink. Further, inside the ink reservoir chamber T04, a stirring member (mechanism) 13 for uniformizing a concentration when a concentration gradient is caused by settling of a settling component of the ink T05 in the ink reservoir chamber T04 is provided. The stirring member T13 is supported by a supporting member T14 provided inside the container and swung by movement of a carriage to which the ink container T00 is mounted, thus performing a stirring operation of the ink in the container. In this embodiment, the stirring member T3 has a plate-like shape but the shape thereof is not limited to the plate-like shape.

At the bottom surface of the ink reservoir chamber T04 with respect to the gravitational direction, the ink supply portion T03 is provided and constitutes a flow passage which communicates with the recording head by contact with a supply passage leading to the recording head. The ink supply portion T03 is provided with a meniscus-forming member T07 and a press-contact member T06 as shown in FIG. 1. The inside of the ink reservoir chamber T04 is kept at negative pressure. In this state, the meniscus-forming member T07 functions as a member for forming a meniscus by the ink T05 so as not to suck air bubbles from the outside of the container into the inside of the ink reservoir chamber. More specifically, a member such that it can generate a meniscus-holding pressure larger than a maximum of the negative pressure generated in the ink reservoir chamber is selected. The press-contact member T06 is constituted by a material having flexibility to some extent so as to absorb positional deviation with respect to a contact direction when the press-contact member T06 is connected to an ink supply port leading to the recording head, and the press-contact member T06 is a member having a capillary force so that it can form a flow passage of the ink T05 during the connection. In this embodiment, the press-contact member T06 is, e.g., constituted by a resinous fiber assembly. An opening of the ink supply portion T03 has a relatively large opening (planar) area capable of meeting an increase in ink flow rate as described later.

Figure 3A:
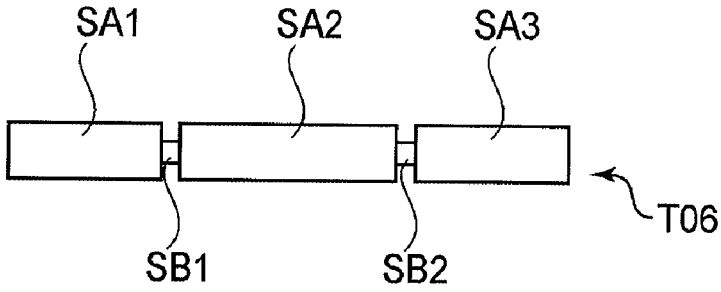
FIG. 3A is a sectional view of a press-contact member provided to the ink container shown in FIG. 1.
Figure 3B:
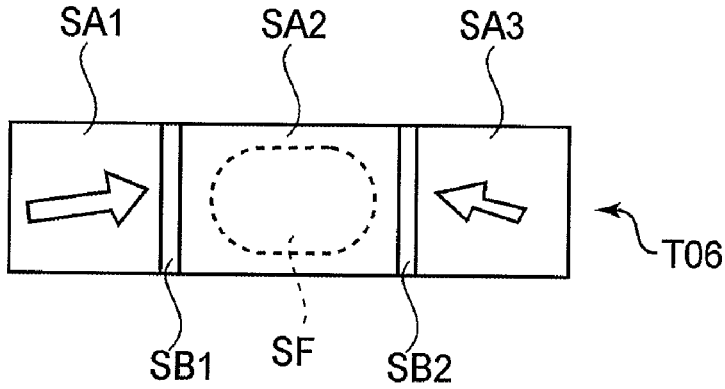
FIG. 3B is a top view of the press-contact member provided to the ink container shown in FIG. 1.

FIGS. 3A and 3B are schematic views for illustrating a shape of the press-contact member T06, wherein FIG. 3A is a side view with respect to a longitudinal direction and FIG. 3B is a bottom view. Referring to these figures, reference symbols SA1 to SA3 represent ink conducting areas or regions in which the ink is movable in the press-contact member from the ink container toward the recording head in an ink supplying direction. Reference symbols SB1 and SB2 are non-conducting areas or regions in which the ink from the conducting area (e.g., SA1 or SA3) cannot enter the non-conducting area (e.g., SB1 or SB2). In FIG. 3B< a reference symbol SF represents a size and position of a filter H01 provided to an ink introducing portion H02 of the recording head to which the ink container is mounted. More specifically, the reference symbols SF represents a size and position of an area of the filter H01 of the recording head contacting the press-contact member in the ink supply passage leading to the recording head.

The ink conducting areas SA1 to SA3 are, as described above, areas constituting a flow passage for moving the ink T05 toward the recording head side when the ink container is connected to the recording head. Further, the ink conducting areas SA1 to SA3 have, as particularly shown in FIG. 3B, boundaries therebetween constituted by the ink non-conducting areas SB1 and SB2 in which the ink cannot be moved.

The ink non-conducting areas SB1 and SB2 are formed by sandwiching a flat plate-like press-contact member T06 between processing hones and heat-fusing the press-contact member while compressing the press-contact member, followed by cooling for solidification. That is, of areas constituting the press-contact member, the ink non-conducting area is an area by which an area in which the ink is movable in the ink supply direction toward the recording head is separated. As means for fusing the press-contact member, in this embodiment, an impulse heater capable of rapid heating and rapid cooling is used. However, the fusing means is not limited to the impulse heater but may also employ fusing by frictional heat such as ultrasonic wave. The heat-fusing by the processing hones may be performed only in one direction with respect to the press-contact member and is only required to prevent movement of the ink between the ink conducting areas. The shape of the ink non-conducting area is only required to continuously extend in a direction intersecting a flow direction (indicated by arrows) of the ink from an end of the press-contact member toward the ink supply port as shown in FIG. 3B, and the press-contact member accepts any width and shape.

The ink non-conducting areas SB1 and SB2, as shown in FIG. 3B, define the ink conducting area SA2 contacting the filter SF of the recording head-side supply passage so as to have a proper planar area. Herein, the proper planar area means a planar area in which all the ink held in an area (the ink conducting area SA2 in this embodiment) for leading the ink through the filter of the recording head can be removed.

Figure 4:
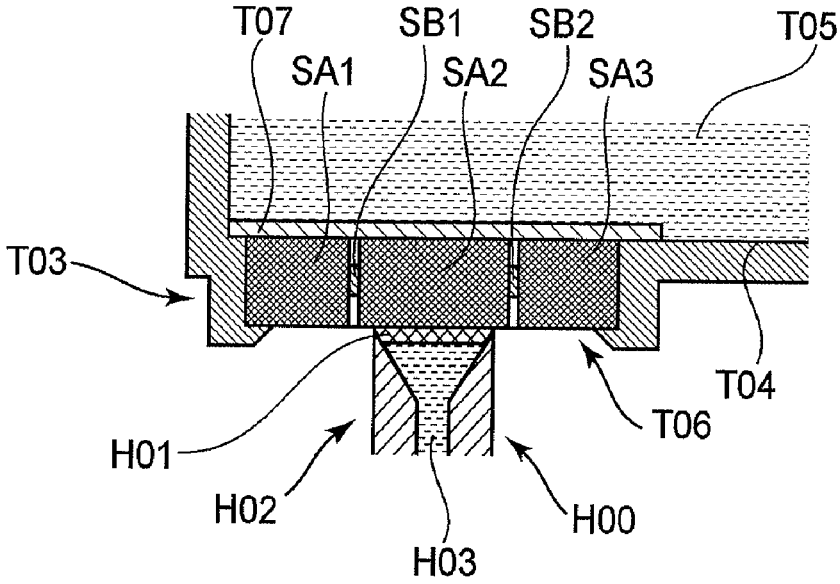
FIG. 4 is a sectional view of a major portion for illustrating connection between the ink container shown in FIG. 1 and a small flow rate recording head.

FIG. 4 is a schematic view showing a mounting state when the ink container of this embodiment is mounted to a printer employing a recording head providing a relatively small ink flow rate and is an enlarged sectional view of a connecting portion as seen in a side direction.

As shown in FIG. 4, the ink container T00 is connected to a recording head H00 so that the ink supply portion T03 communicates with an ink introducing portion H02 located at an upper portion of the recording head H00 with respect to a gradational direction (downward direction) for the ink reservoir chamber T04. The ink introducing portion H02 is formed at an end portion of the ink flow passage H03 and provided with the filter H01. The ink introducing portion H02 and the ink flow passage H03 constitute an ink supply passage with respect to the recording head. The ink communication between the ink container T00 and the recording head H00 is performed by contact of the bottom of the press-contact member T06 with the filter H01 of the recording head H00.

In the case shown in FIG. 4, the filter H01 has a small planar area, so that the filter H01 contacts only the ink conducting area SA2. As a result, only the ink conducting area SA2 constitutes a flow passage capable of supplying the ink to the recording head H00. That is, the ink held at the press-contact member end portion is constituted so as not to enter the recording head side by the ink non-conducting areas SB1 and SB2. The ink T05 held in the ink conducting areas SA1 and SA3 which do not contact the filter H01 is constituted so as not to enter the ink flow passage H03 through the filter H01.

Next, action of the above constituted ink container of this embodiment will be described.

Figure 5A:
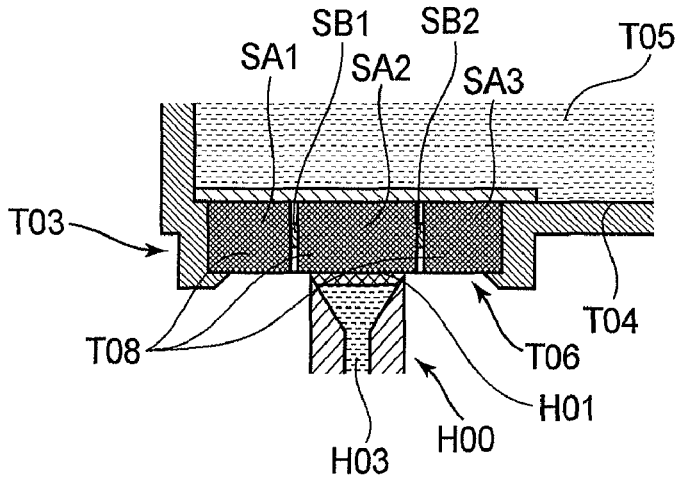
Figure 5B:
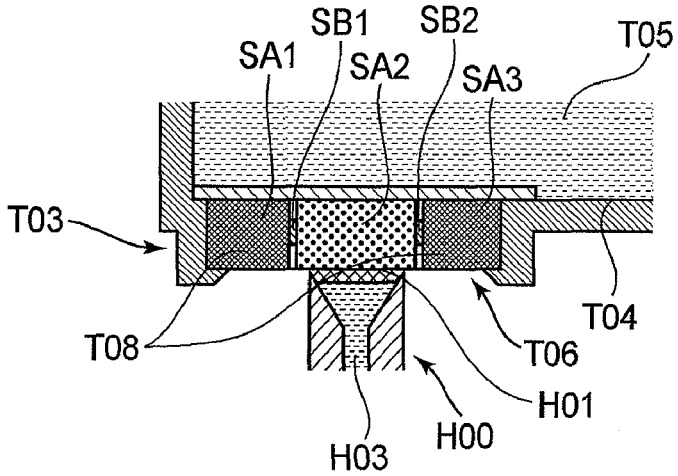
Figure 5C:
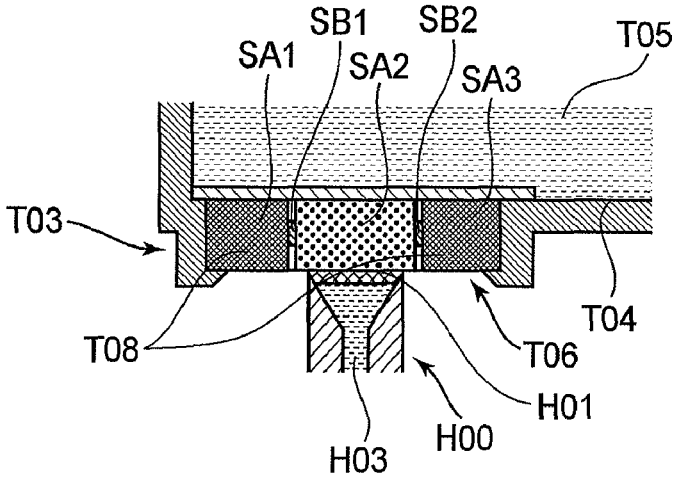
Figure 9A:
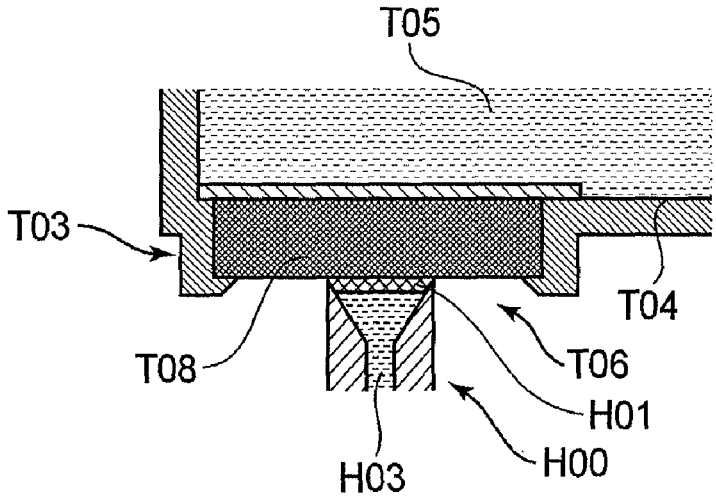
FIG. 9A is a sectional view of a major portion for illustrating connection between a conventional ink container and a small flow rate recording head.
Figure 9B:
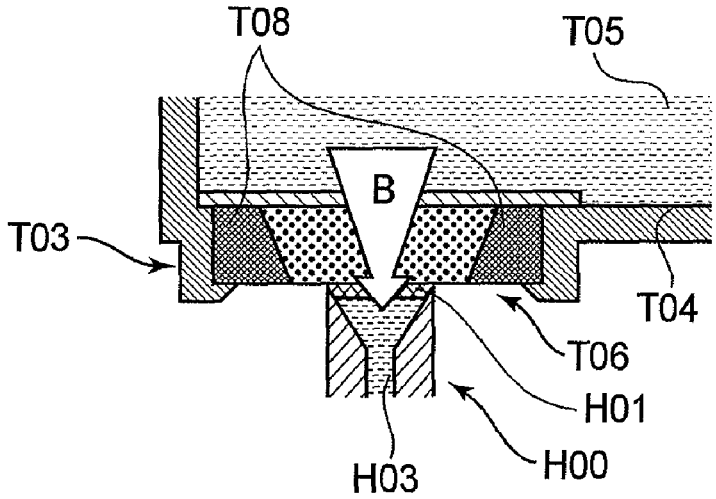
FIG. 9B is a sectional view for illustrating pigment settling at an inner portion of a press-contact member of the conventional ink container after a suction refreshing operation.
Figure 9C:
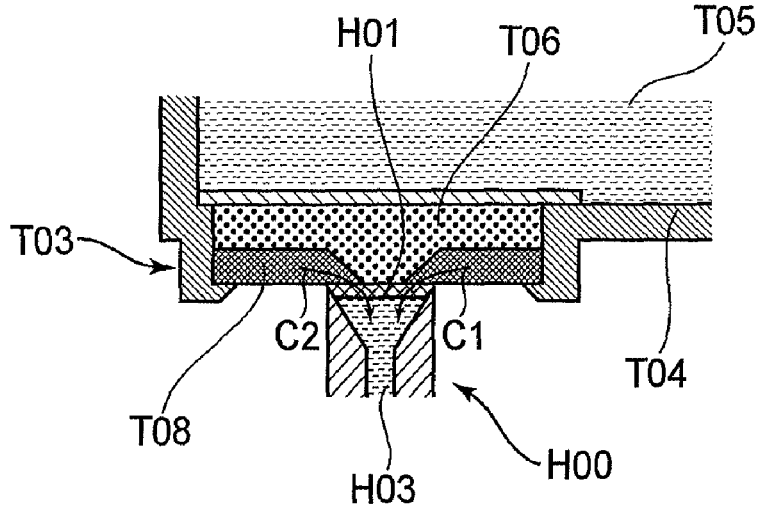
FIG. 9C is a sectional view for illustrating pigment settling at an inner portion of the press-contact member of the conventional ink container after the conventional ink container is subjected to the suction refreshing operation and then is left standing.

FIGS. 5A to 5C show the ink container of this embodiment and are sectional views for illustrating behavior of ink increased in concentration by settling particles during settling of pigment particles. Further, FIGS. 9A to 9C are sectional views for illustrating ink behavior in a conventional ink container provided with a press-contact member. In the following, the action of the ink container of this embodiment will be described while comparing the ink behavior of the ink container of this embodiment with the ink behavior of the conventional ink container.

FIG. 5A and FIG. 9A each shows a state after a stirring operation of an associated ink container in a printer of this embodiment. The stirring operation performs stirring of the ink by swing of the stirring member T13 shown in FIG. 2B provided in the ink container during scanning of the carriage for the printer (recording apparatus). FIG. 9A shows a settling state of ink pigment particles in the conventional ink container. In this state, the ink T05 in the ink container has a uniform concentration as indicated by broken lines. When the ink container T00 in which the settling of the pigment component results in an advance stage is moved by the carriage to stir the ink T05 in the ink container, the concentration of the ink is uniformized. However, the ink held in the press-contact member T06 indicated by crossed oblique lines is not affected by the stirring, so that the concentration of the ink is not uniformized. For this reason, as shown in FIGS. 5A and 9A, pigment-settled ink T08 still remains in the press-contact member T06.

FIG. 5B and FIG. 9B each illustrates a settling state of the ink in the ink container immediately after a suction operation is performed by the printer. In the case of the ink container of this embodiment, as shown in FIG. 5B, the settling ink T08 in the ink conducting area SA2 with which the filter H01 is brought into contact is removed by the suction operation. As a result, the concentration-uniformized ink T05 present in the ink container T04 indicated by the broken lines in FIG. 5B is introduced into the ink conducting area SA2 of the press-contact member T06 after the suction operation is completed (indicated by dotted portion in FIG. 5B). In other ink conducting areas SA1 and SA3 with which the filter H01 is not brought into contact, the settling ink T08 still remains without being removed (indicated by the crossed oblique lines in FIG. 5B).

On the other hand, in the conventional ink container provided with the (conventional) press-contact member, as shown in FIG. 9B, the settling ink T08 is removed in an area in which flow of ink in a direction indicated by an arrow B is caused by the suction operation. As a result, into the area (indicated by dotted portion of FIG. 9B), the concentration-uniformized ink T05 in the ink reservoir chamber T04 flows. However, into areas constituting both end portions of the press-contact member T06, the ink T05 does not flow, so that the high concentration ink still remains in the areas (indicated by the crossed oblique lines in FIG. 9B) of the press-contact member T06.

FIGS. 5C and 9C each illustrates a settling state of the ink in the ink container when the ink container is left standing for several hours from the state shown in FIG. 5B or FIG. 9B. That is, FIGS. 5C and 9C each illustrates a settling state of the ink in the ink container after the ink container is subjected to the suction operation and then is left standing for several hours.

As shown in FIG. 9C, in the conventional ink container provided with the press-contact member, the settling ink T08 which has not been removed by the suction operation gradually diffuse in directions indicated by arrows C1 and C2 when the ink container is left standing for several hours after the suction operation. As a result, the ink containing the settled pigment particles is supplied to the recording head H00 through the ink flow passage H03 and ejected from the recording head H00 to adversely affect a recording quality, thus causing (image) density non-uniformity or the like in some cases.

On the other hand, in the ink container T00 of this embodiment, the settling state of the ink is shown in FIG. 5C. More specifically, the settling ink T08 remaining in the ink conducting areas SA1 and SA3 is blocked from flowing into the recording head H00 by the ink non-conducting areas SB1 and SB2. As a result, the ink having a non-uniform colorant concentration such as a high colorant concentration is caused to remain in the ink conducting areas SA1 and SA3. Therefore, it is possible to prevent supply of the high concentration ink to the recording head H00.

As described above, in order to obviate the influence of the ink having the non-uniform colorant concentration on a recording quality, it is desirable that the ink conducting area SA2 contacting the filter H01 has a size capable of removal of all the ink held in the ink conducting area SA2 by the suction operation. This is because the high concentration ink can be removed by the suction operation even when the high concentration ink remains in the ink conducting area SA2. With reference to FIGS. 6A, 6B, 7A and 7B, an experimental embodiment for determining optimum positions of the ink non-conducting areas SB1 and SB2 defining the size of the ink conducting area SA2 will be described.

Figure 6A:
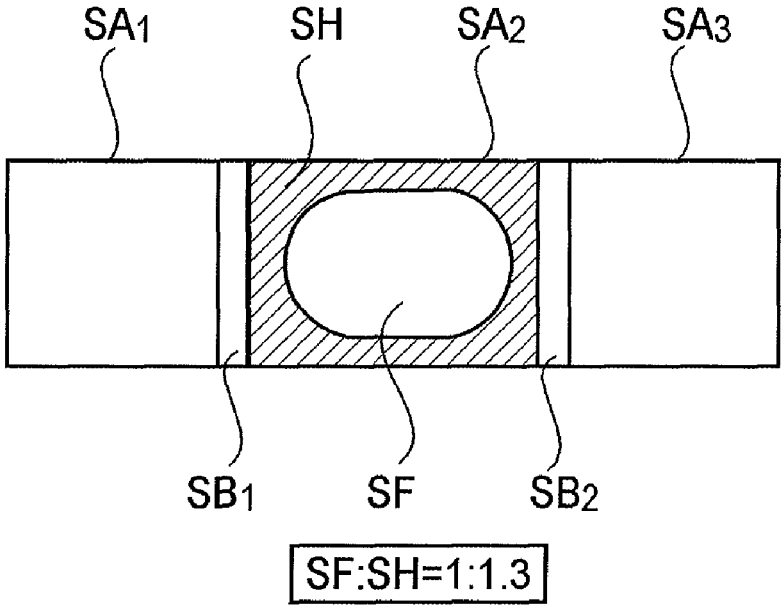
FIG. 6A is an area distribution view of a contact surface between the press-contact member and a filter.
Figure 6B:
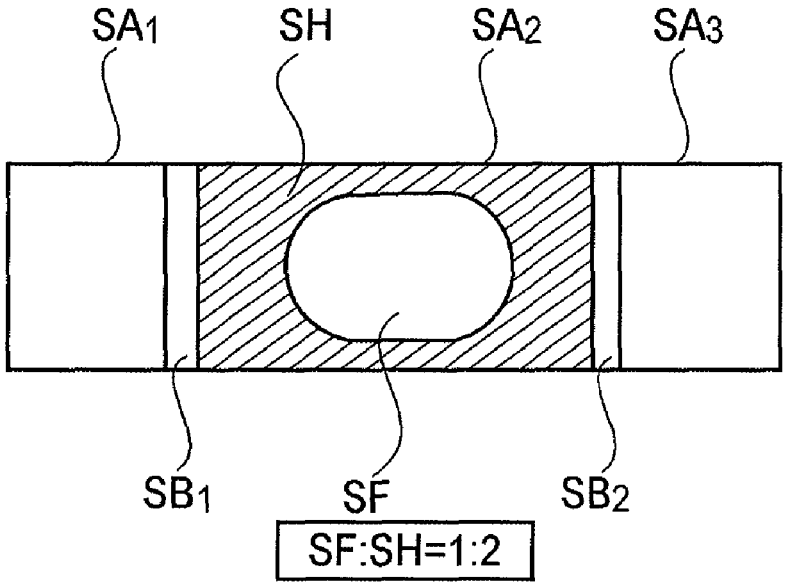
FIG. 6B is an area distribution view at a contact surface between a press-contact member and a filter in the case where a non-contact area between the press-contact member and the filter is larger than that between the press-contact member and the filter shown in FIG. 6A.

FIGS. 6A and 6B are bottom views of a press-contact member T06 subjected to the experimental embodiment. FIG. 6A shows a press-contact member in which an ink conducting area SA2 is designed so that a planar areal ratio between a contact area SF with the filter H01 and a non-contact area SH with the filter H01 is set to satisfy SF:SH=1:1.3. FIG. 6B shows a press-contact member in which an ink conducting area SA2 is designed so that a planar areal ratio between the contact area SF and the non-contact area SH is set to satisfy SF:SH=1:2.

Each of the above designed two types of the press-contact members T06 is incorporated into an ink container T00 filled with ink corresponding to high concentration ink in which pigment particles are placed in an advanced settling state. Each of the resultant ink containers is mounted to a printer to which a recording head H00 provided with the filter H01 having the contact area SF is also mounted, and is subjected to stirring and a suction operation.

Prints obtained by recording immediately after the stirring and the suction operation ("after stirring") and prints obtained by recording after the ink container was subjected to the stirring and the suction operation and was then left standing for 3.5 hours at 60° C. ("after standing") were prepared. Each of the thus prepared prints was compared with a print obtained by recording with fresh ink having a uniform pigment concentration to evaluate a state of (image) density non-uniformity. More specifically, images obtained by the recording were compared at each of density levels from 0 to 32 to determine a color difference ΔE at a predetermined point. The color difference ΔE means a difference in color between two colors in a color space and can be obtained as a numerical value on the basis of a calorimetric system such as Munsell calorimetric system, L*a*b* calorimetric system, L*C*h* calorimetric system, Hunter Lab calorimetric system, or XYZ calorimetric system. When the difference in color (ΔE) between two colors obtained from the calorimetric system is smaller, a better image is obtained. When the color difference (ΔE) is larger, a resultant image is worsened by eye observation. In this experimental embodiment, when ΔE exceeds 6, the image is judged as a no-good image.

The evaluation results are shown in Table 1.

TABLE 1

| Press-contact member | After stirring | After standing |
|---|---|---|
| SF:SH = 1:1.3 | Excellent | Excellent |
| SF:SH = 1:2 | Excellent | Good or Fair |

As a result of the experimental embodiment described above, it is confirmed that a lowering in recording quality in terms of density non-uniformity is not caused at a certain areal ratio or less. In the ink container of this embodiment, as shown in Table 1, it has been confirmed that it is possible to effect good recording when the planar area ratio between the non-contact area SH of the filter H01 with the ink conducting area SA2 and the contact area SF of the filter H01 with the ink conducting area SA2 is SF:SH=1:1.3 or less. The above experimental results vary depending on differences in setting factors such as a suction performance of a printer in terms of the used ink, so that the SF:SH ratio may appropriately be changed depending on the factors.

Figure 7A:
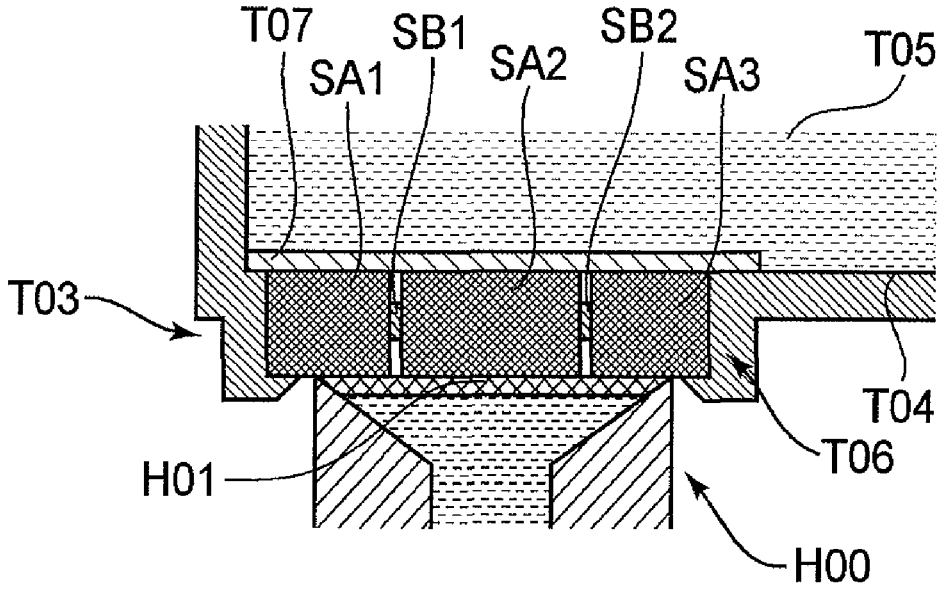
FIG. 7A is a sectional view of a major portion for illustrating connection between the ink container shown in FIG. 1 and a large flow rate recording head.
Figure 7B:
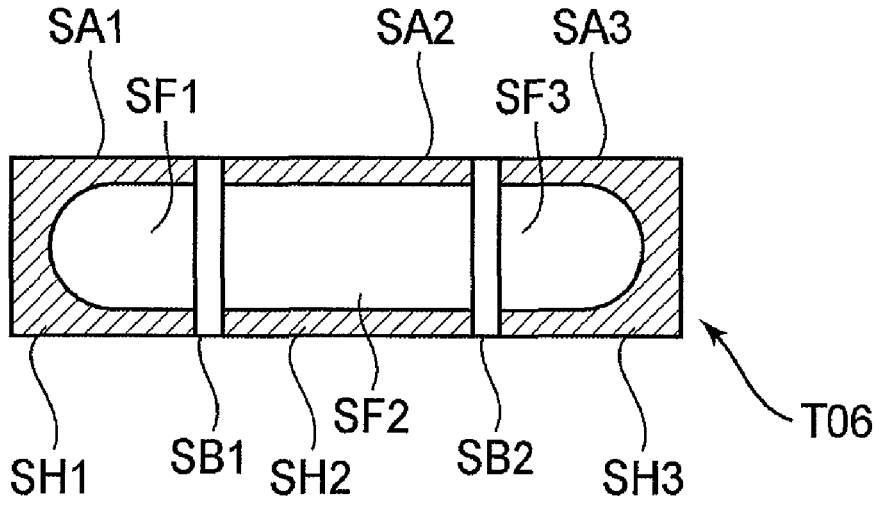
FIG. 7B is an area distribution view at a contact surface between the press-contact member of the ink container shown in FIG. 7A and a filter.

FIGS. 7A and 7B are schematic views for illustrating a connection state in the case where the ink container of this embodiment is used in a connection state with a recording head providing an expected maximum flow rate. That is, these figures show the case where the ink container of this embodiment is connected to a recording head providing an ink supply amount larger than that provided by the recording head shown in FIG. 4 and then is used. FIG. 7A is an enlarged sectional view of a connecting portion, and FIG. 7B is a schematic view showing area distribution at a contact surface between the press-contact member and a filter of the recording head when the ink container is connected to the recording head.

As shown in FIG. 7A, the filter H01 of the recording head H00 contacts each of the ink conducting areas SA1 to SA3 of the press-contact member T06 while being in non-contact with the ink non-conducting areas SB1 and SB2. In this case, area distribution of the press-contact member T06 is shown in FIG. 7B.

The contact area SF of the filter H01 is separated by the ink non-conducting areas SB1 and SB2. More specifically, contact areas SF1, SF2 and SF3 are located in the ink conducting areas SA1, SA2 and SA3, respectively. In this case, non-contact areas SH1, SH2 and SH3 are located adjacent to the contact areas SF1, SF2 and SF3, respectively. By applying the above described experimental results to this case, sizes of the press-contact member T06 and the filter H01 and determined so that planar areal ratios, for the ink conducting areas SA1 to SA3, between contact areas SFn (n=1, 2 and 3) and non-contact areas SHn (n=1, 2 and 3) satisfy SFn:SHn=1:1.3 or less. As a result, even when the recording head contacting the press-contact member is changed, it is possible to ensure commonalty of the ink container of this embodiment with respect to the recording heads before and after the change. Incidentally, the filter H01 has portions corresponding to the ink non-conducting areas SB1 and SB2 of the press-contact member. These portions are ineffective areas, so that it is necessary to design the filter H01 in consideration of these ineffective portions.

Figure 8A:
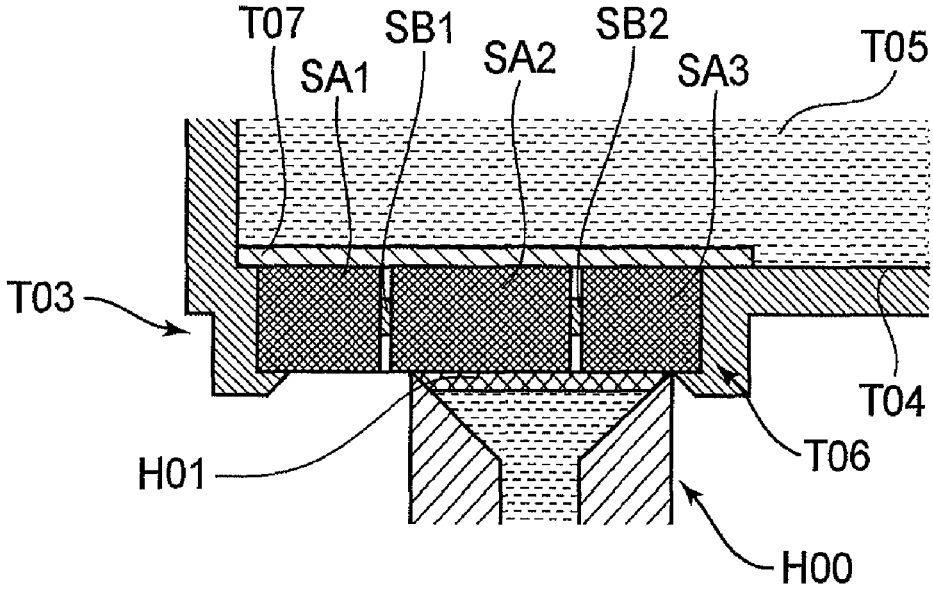
FIG. 8A is a sectional view of a major portion for illustrating connection between the ink container shown in FIG. 1 and a medium flow rate recording head.
Figure 8B:
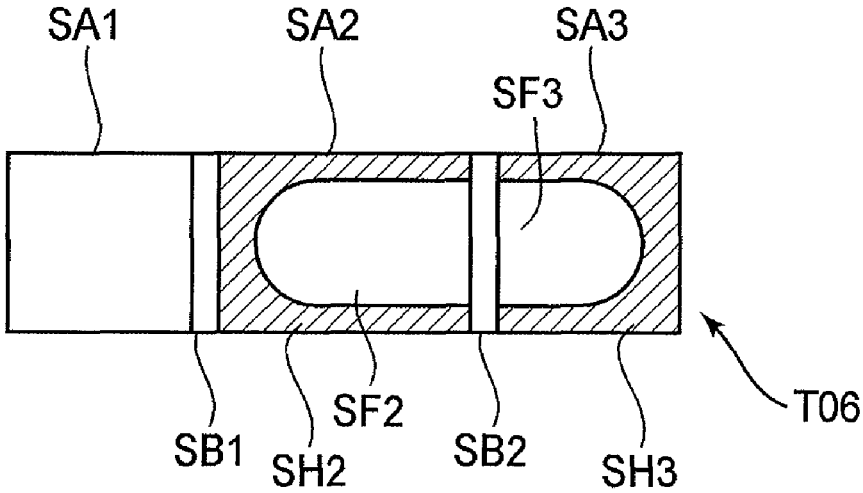
FIG. 8B is an area distribution view at a contact surface between the press-contact member of the ink container shown in FIG. 8A and a filter.

FIGS. 8A and 8B are schematic views showing a press-contact member contacting a recording head providing a medium flow rate between the expected maximum flow rate provided by the recording head (FIGS. 7A and 7B) and the small flow rate given by the recording head (FIG. 4). That is, these figures show a connection state in the case where the ink container of this embodiment is connected to the recording head. FIG. 8A is an enlarged sectional view of a connecting portion, and FIG. 8B is a schematic view showing area distribution at a contact surface between the press-contact member and a filter of the recording head when the ink container is connected to the recording head.

As shown in FIG. 8A, the filter H01 of the recording head H00 contacts each of the ink conducting areas SA2 and SA3 of the press-contact member T06 while being in non-contact with the ink non-conducting area SB2. In this case, area distribution of the press-contact member T06 is shown in FIG. 8B.

The contact area SF of the filter H01 is separated by the ink non-conducting area SB2. More specifically, contact areas SF2 and SF3 are located in the ink conducting areas SA2 and SA3, respectively. In this case, non-contact areas SH2 and SH3 are located adjacent to the contact areas SF2 and SF3, respectively. By applying the above described experimental results to this case, sizes of the press-contact member T06 and the filter H01 and determined so that planar areal ratios, for the ink conducting areas SA2 and SA3, between contact areas SFn (n=2 and 3) and non-contact areas SHn (n=2 and 3) satisfy SFn:SHn=1:1.3 or less. As a result, even when the recording head contacting the press-contact member is changed, it is possible to ensure commonality of the ink container of this embodiment with respect to the recording heads before and after the change. Incidentally, the filter H01 has portion corresponding to the ink non-conducting area SB2 of the press-contact member. This portion is an ineffective area, so that it is necessary to design the filter H01 in consideration of this ineffective portion similarly as in the above case described with reference to FIGS. 7A and 7B.

Other Embodiments

In First Embodiment described above, the shape of the ink non-conducting areas SBn is a linear shape in order to minimize the ineffective area of the filter H01 when the large (maximum) flow rate-recording head is connected to the press-contact member. However, in the present invention, the shape of the ink non-conducting areas is not limited to the linear shape.

Figure 10A:
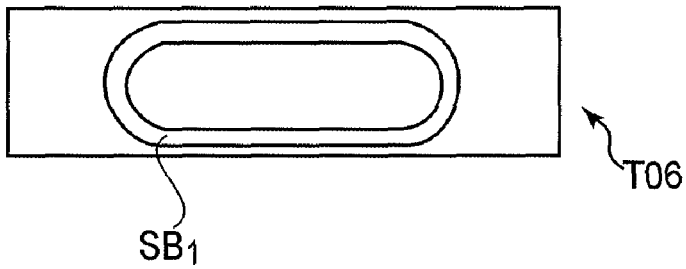
FIGS. 10A to 10C are to views each showing a press-contact member used in an embodiment of the present invention.
Figure 10B:
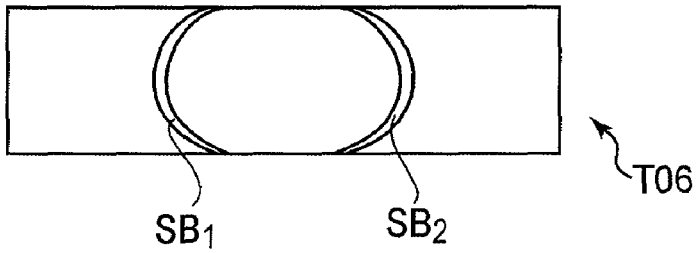

For example, the shape may be an elongated looped shape such that an ink non-conducting area SB1 is closed as shown in FIG. 10A. Further, the ink non-conducting areas may also be arc-shaped ink non-conducting areas SB1 and SB2 as shown in FIG. 10B.

Figure 10C:
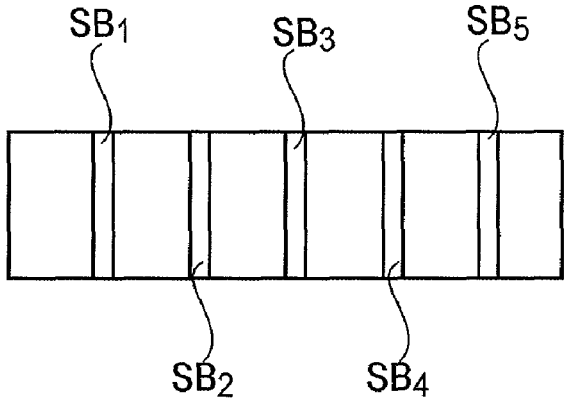

The number of the ink non-conducting areas SBn is 2 in First Embodiment in order to realize commonality of the ink container with respect to the above described three types of the recording heads but is not limited to 2 in the present invention. As shown in FIG. 10C, the number of the ink non-conducting areas is increased, whereby it is possible to ensure commonality of the ink container with respect to more types of recording heads.

In First Embodiment the ink container is used for containing the pigment ink but the ink used in the present invention is not limited to the pigment ink. Even in the case of an ink container containing ink using a dye as a colorant, e.g., viscosity-increased ink can adversely affects a recording result. More specifically, as described with reference to FIGS. 9A to 9C, all the dye ink in the press-contact member cannot be removed by suction in some cases. For example, the dye ink remaining in the press-contact member is increased in viscosity and thereafter flows into the recording head side, so that density non-uniformity can occur in a recording image. Thus, the use of the press-contact member to which the present invention is applied is preferable also in an ink container for containing ink in general in addition to the pigment ink.

Figure 11:
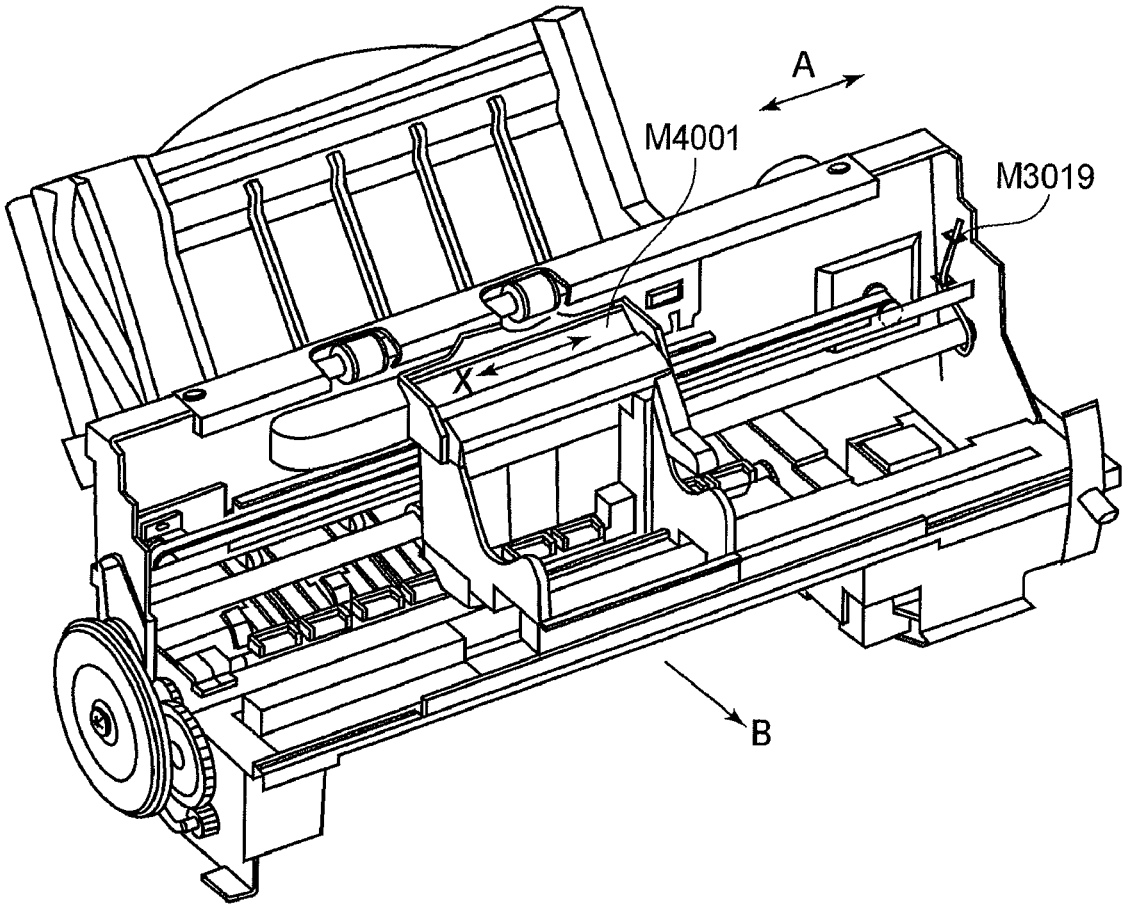
FIG. 11 is a perspective view showing an ink jet recording apparatus in an embodiment of the present invention.

FIG. 11 is a schematic view for illustrating a constitutional embodiment of an ink jet recording apparatus capable of employing the above described ink container and recording head.

Referring to FIG. 11, the ink jet recording apparatus of this embodiment is constituted by an apparatus main assembly, a sheet-feeding portion, a sheet discharge tray, etc. The apparatus main assembly is, as shown in FIG. 11, constituted by a chassis M3019, a recording operation mechanism, and the like. The recording operation mechanism includes a carriage M4001 which is reciprocable in a main scanning direction indicated by a double-pointed arrow A. To the carriage M4001, an ink container containing ink and an ink jet recording head capable of ejecting the ink supplied from the ink container through a plurality of ink ejection outlets are mounted. The ink container is constituted separably from the recording head and can be replaced with a new ink container when an amount of the ink contained in the ink container becomes small. The recording head is capable of ejecting the ink by using, e.g., an electrothermal transducer (heater) or a piezoelectric element. In the case of using the electrothermal transducer, ink is caused to generate bubbles by heat generation of the electrothermal transducer, so that it is possible to eject the ink through the ink ejection outlets by utilizing bubble generation energy. A recording sheet (recording medium) fed from the sheet-feeding portion is conveyed in a sub-scanning direction indicated by an arrow B.

When an image is recorded on the recording sheet, a recording operation and a conveying operation are repeated. In the recording operation, the recording head ejects the ink from the ink ejection outlets while moving together with the carriage M4001 and the ink container in the main scanning direction. In the conveying operation, the recording sheet is conveyed in a predetermined amount in the sub-scanning direction. By repeating the recording operation and the conveying operation, an image is successively recorded on the recording sheet.

At one end portion of a movement path of the carriage M4001, a refreshing unit is provided and performs operations of wiping, preliminary ejection, and suction. By these operations, it is possible to maintain an ejection performance of the recording head in good condition. A suction amount by the suction operation is, as described above, designed so that all the ink held in the ink conducting area can be removed depending on a planar area of the ink conducting area in the press-contact member T06.

As described above, the ink container according to the present invention includes the press-contact member at the ink supply portion and is constituted so that the ink container can be used in common with respect to recording heads different in flow rate. By realizing commonality of the press-contact member, it is possible to cut out the need of development of an ink container for each development of a new recording head in terms of an ink flow rate (supply amount). Thus, it is possible to reduce development cost and investment in plant and equipment. As a result, it is possible to reduce production cost of the ink container, so that an inexpensive ink can be provided.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 246045/2006 filed Sep. 11, 2006, which is hereby incorporated by reference.

What is claimed is:

1. An ink container constructed for use in common with first and second different recording heads, wherein the first recording head includes an ink introducing area having a first size and the second recording head includes an ink introducing area having a second size larger than the first size, wherein the ink container comprises:

an ink reservoir chamber for containing ink; and a press contact member connectable to the first and second ink introducing areas of the first and second recording heads, wherein the press contact member has a first conducting area to which both of the first ink introducing area having the first size and the second ink introducing area having the second size are connectable, a second conducting area to which the second ink introducing area having the second size is contactable but to which the first ink introducing area having the first size is not contactable, and a non-conducting area which is provided between the first conducting area and the second conducting area and which is configured to block movement of the ink from the second conducting area to the first conducting area.

2. The container according to claim 1, wherein the non-conducting area is smaller than the first conducting area and the second conducting area at a surface at which the press contact member is contactable to the first and second ink introducing areas.

3. The container according to claim 1, wherein the press contact member comprises a fibrous member formed of resin fibers.

4. The container according to claim 1, wherein the non-conducting area is formed by heat fusing.

5. The container according to claim 1, wherein the non-conducting area is formed by heat fusing at a surface of the press contact member.

6. The container according to claim 1, wherein the non-conducting area is formed by heat fusing at opposing surfaces of the press contact member.

7. The container according to claim 1, wherein the non-conducting area is formed with respect to a direction intersecting an ink flowing direction from the first conducting area to the second conducting area.

8. The container according to claim 1, wherein the ink is pigment ink.

9. An ink jet recording apparatus for effecting recording by using a recording head for ejecting ink, wherein the recording head includes a first ink introducing area having a first size which differs from that of a second ink introducing area of another recording head, wherein the ink jet recording apparatus comprises:

mounting means to which an ink container for supplying ink to the recording head is detachably mountable; and suction means for sucking the ink through the recording head in a state in which the ink container and the first ink introducing area are connected to each other, wherein the ink container includes an ink reservoir chamber for containing ink, and a press contact member connectable to the first and second ink introducing areas, wherein the press contact member has a first conducting area to which both of the first ink introducing area and the second ink introducing area are connectable, a second conducting area to which one of the first and second ink introducing areas is contactable but to which the other of the first and second ink introducing areas is not contactable, and a non-conducting area which is provided between the first conducting area and the second conducting area and which is configured to block movement of the ink from the second conducting area to the first conducting area; and wherein the suction means is capable of sucking all of ink contained in a conducting area in contact with the first ink introducing area.

10. A press contact member for an ink container containing pigment ink, comprising:

a plurality of conducting areas including first and second conducting areas through which the pigment ink is movable; and a non-conducting area which defines a boundary between the first and second conducting areas and which is configured to block movement of pigment ink from the first conducting area to the second conducting area.

* * * * *